US009080282B2

(12) United States Patent
Zambrowicz et al.

(10) Patent No.: US 9,080,282 B2
(45) Date of Patent: Jul. 14, 2015

(54) LAUNDRY MOISTURE SENSING, CONTROL, DIAGNOSTIC AND METHOD

(75) Inventors: Michael J. Zambrowicz, Ripon, WI (US); Stephen L. Harris, Oshkosh, WI (US); Robert Socha, Green Lake, WI (US)

(73) Assignee: Alliance Laundry Systems, LLC, Ripon, WI (US)

( * ) Notice: Subject to any disclaimer, the term of this patent is extended or adjusted under 35 U.S.C. 154(b) by 664 days.

(21) Appl. No.: 13/361,375

(22) Filed: Jan. 30, 2012

(65) Prior Publication Data

US 2013/0192081 A1 Aug. 1, 2013

(51) Int. Cl.

| | |
|---|---|
| ***F26B 25/00*** | (2006.01) |
| ***D06F 58/04*** | (2006.01) |
| ***D06F 58/28*** | (2006.01) |

(52) U.S. Cl.

CPC ..... *D06F 58/04* (2013.01); *D06F 58/28* (2013.01); *D06F 2058/2838* (2013.01); *D06F 2058/2883* (2013.01)

(58) Field of Classification Search

CPC ..... D06F 39/004; G01D 5/24; G01N 27/048; G01N 27/121

USPC ..... 34/282, 528

See application file for complete search history.

(56) References Cited

U.S. PATENT DOCUMENTS

| | | | | | |
|---|---|---|---|---|---|
| 3,110,005 | A * | 11/1963 | Kripke | 338/35 |
| 3,417,480 | A * | 12/1968 | Thunander | 34/528 |
| 3,651,579 | A * | 3/1972 | Smith | 34/532 |
| 3,660,909 | A * | 5/1972 | Willcox | 34/533 |
| 3,733,712 | A * | 5/1973 | Smith | 34/532 |
| 3,782,001 | A * | 1/1974 | Cotton | 34/532 |
| 4,215,486 | A * | 8/1980 | Heyer et al. | 34/527 |
| 4,385,452 | A * | 5/1983 | Deschaaf et al. | 34/562 |
| 5,578,753 | A * | 11/1996 | Weiss et al. | 73/335.02 |
| 8,707,580 | B2 * | 4/2014 | Hopkins | 34/527 |
| 2006/0179676 | A1 * | 8/2006 | Goldberg et al. | 34/77 |
| 2006/0242859 | A1 * | 11/2006 | Pezier | 34/528 |
| 2008/0052951 | A1 * | 3/2008 | Beaulac | 34/549 |
| 2009/0025250 | A1 * | 1/2009 | Koo et al. | 34/491 |
| 2009/0079607 | A1 * | 3/2009 | Denison et al. | 341/143 |
| 2009/0172969 | A1 * | 7/2009 | Kim | 34/491 |
| 2009/0199427 | A1 * | 8/2009 | Han | 34/486 |
| 2009/0260256 | A1 * | 10/2009 | Beaulac | 34/528 |
| 2010/0050464 | A1 * | 3/2010 | Krzelowski et al. | 34/380 |

OTHER PUBLICATIONS

English translation of Gorny reference, DE102007052836A1.*

* cited by examiner

*Primary Examiner* — Kenneth Rinehart

*Assistant Examiner* — Jason Lau

(74) *Attorney, Agent, or Firm* — Leydig, Voit & Mayer, Ltd.

(57) ABSTRACT

A laundry dryer includes a drum. A moisture sensing system detects an average moisture content of launderable items as they are dried within the drum and provides a moisture signal to an electronic controller. A user interface presenting a set-point selection element such that when a moisture setpoint is selected by a machine operator during a drying cycle, an operational state of the dryer machine is controlled by the electronic controller based on the moisture setpoint and the moisture signal.

13 Claims, 11 Drawing Sheets

LAUNDRY MOISTURE SENSING, CONTROL, DIAGNOSTIC AND METHOD

FIELD OF THE INVENTION

The present invention relates generally to laundry dryers, and more particularly, to an improved method and apparatus for sensing and controlling moisture levels in laundered items during a drying operation.

BACKGROUND OF THE INVENTION

In laundry dryers, and particularly laundry dryers used in commercial environments, it is desirable to dry laundered items to different degrees of remaining moisture content depending upon the nature and application of the items being dried. For example, in hotel operations, it is common to dry towels to a point where they exhibit little or no remaining moisture. On the other hand, when drying sheets and other linens, it is often more efficient to stop the drying operation when the items still have a higher degree of remaining moisture content in order to facilitate subsequent ironing or finishing of the item prior to reuse.

In a clothes dryer equipped with moisture sensing controls, the dryer's electronic control may monitor the moisture level in the laundered garment, and terminate the drying cycle when the moisture sensing input indicates to the control that the garments are at the desired final moisture content. The operator of the clothes dryer must typically instruct the electronic control what the target final moisture content should be for a particular load of garments. This is done by programming the electronic control with a parameter value which is the desired final moisture content for the load of garments. This desired final moisture content value may be a specific numerical value for the percent moisture remaining in the garment load, such as "5% final moisture content." Alternatively, the value may be a more qualitative value such as "Damp," "Dry," or "Overdry" which defines the final moisture content in more general terms.

In many cases, however, the operator of the clothes dryer is not able to specify what the final moisture content should be. In some cases the operator of the clothes dryer may need to physically touch the garments to determine whether they are dry enough for the operator to stop the drying cycle. In other words, the operator may not know what various specific numerical percentages of moisture content feel like, but if the garments "feel" dry enough to the touch, then the operator knows to stop the drying cycle.

If the garments still feel too damp, the operator may then continue the drying cycle and periodically check the garments. By trial and error, the operator may eventually acquire a feel for what percentages correlate to which physical feel, and may thus become more adept at setting values for final moisture content.

Moreover, many different variables also affect the ability of the electronic control of the dryer to accurately detect the final moisture content of the items being dried: the ambient temperature and humidity, variations in the material type of garments in the load, a mixture of different garment material types in the load, variations in the electrical input power to the machine, and variations in the load sizes. Any of these variables may result in the electronic control not being able to dry the garment load to the desired final moisture content as specified by the user. Heretofore it has been difficult to alter or modify the control to compensate for such further variable conditions.

Moreover, if the moisture sensing input is not working properly, the electronic control will not be able to sense the moisture content of the garments. A number of factors could affect the quality of the signal at the moisture sensing input: wiring or electrical connections which have become broken, disconnected or shorted, a buildup of residue or contaminant on the cylinder and baffles preventing accurate sensing of the load moisture content, drifting of a moisture sensor device, and/or a complete or partial failure of the electronic control. When inconsistent results for particular drying settings occur, it has been difficult for the user to easily determine whether the dryer control is functioning properly without extensive or cumbersome disassembly of the dryer and its controls.

OBJECTS AND SUMMARY OF THE INVENTION

It is an object of the present invention to provide a laundry dryer having an improved control for monitoring and controlling the moisture content of laundered items during a drying operation.

Another object is to provide a laundry dryer as characterized above having a control that can be more precisely preset for a particular drying operation.

A further object is to provide a dryer of the foregoing type in which the moisture sensing control can be easily set for a desired moisture level for particular types of laundered items under different drying conditions. A related object is to provide an improved method of setting such a moisture sensing control of the dryer.

Still another object is to provide a laundry dryer in which the operative status of the dryer control can be easily tested and verified. A related object is to provide a simple method that allows the operator of the dryer to verify the operative status of the moisture sensing input by using an electronic control user interface rather than requiring sophisticated maintenance tools or having to disassemble the machine to gain access to the moisture sensing components.

Other objects and advantages of the invention will become apparent upon reading the following detailed description and upon reference to the drawings, in which:

Figure 1:
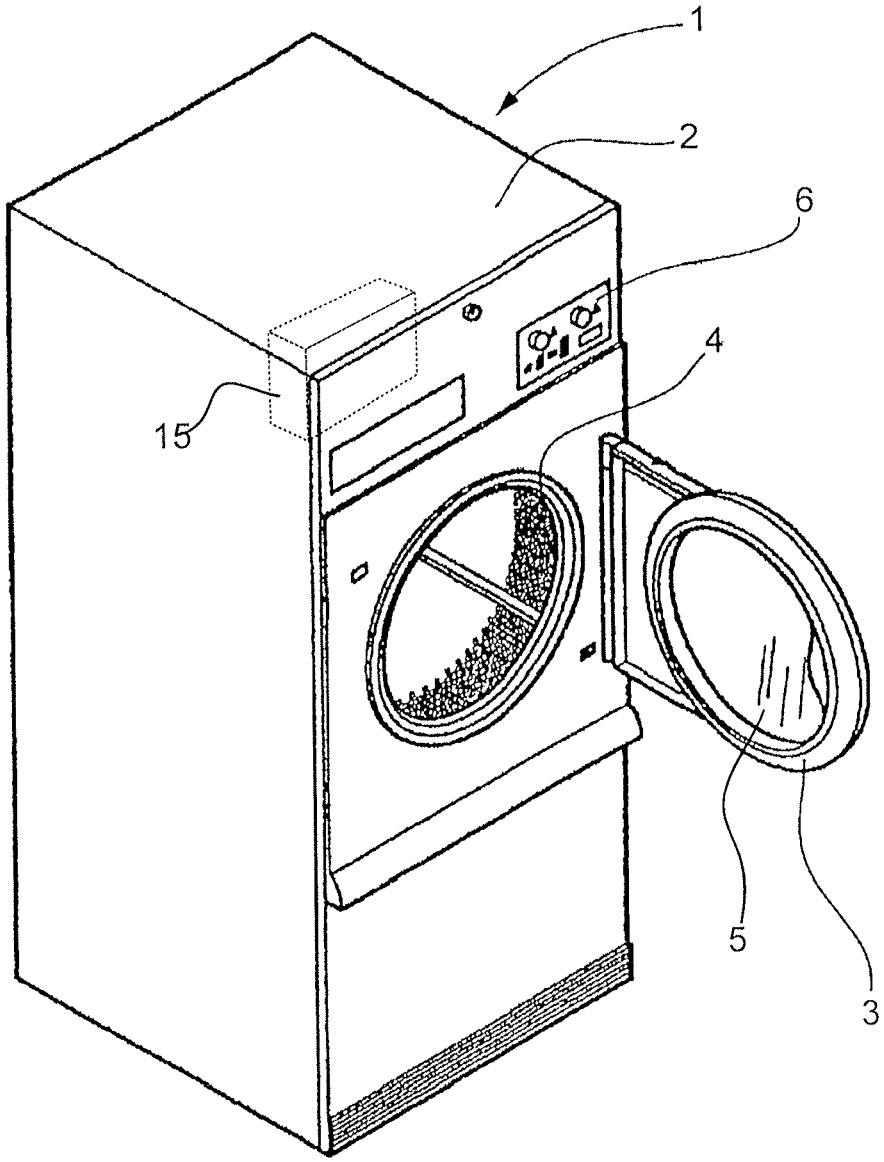
FIG. 1 is a perspective view of a laundry dryer within which embodiments of the present invention may be implemented.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENTS

Referring now more particularly to the drawings, there is shown an illustrative laundry dryer 1 in accordance with the invention. The dryer 1 in this case has a generally rectangular cabinet 2 with a hinge-mounted front opening door 3 for providing access to a front opening cylindrical tumbler or drum 4 rotatably supported within the cabinet 2. The door 3 has a glass pane 5 for permitting operator viewing of laundered items within the dryer during operation.

Figure 2:
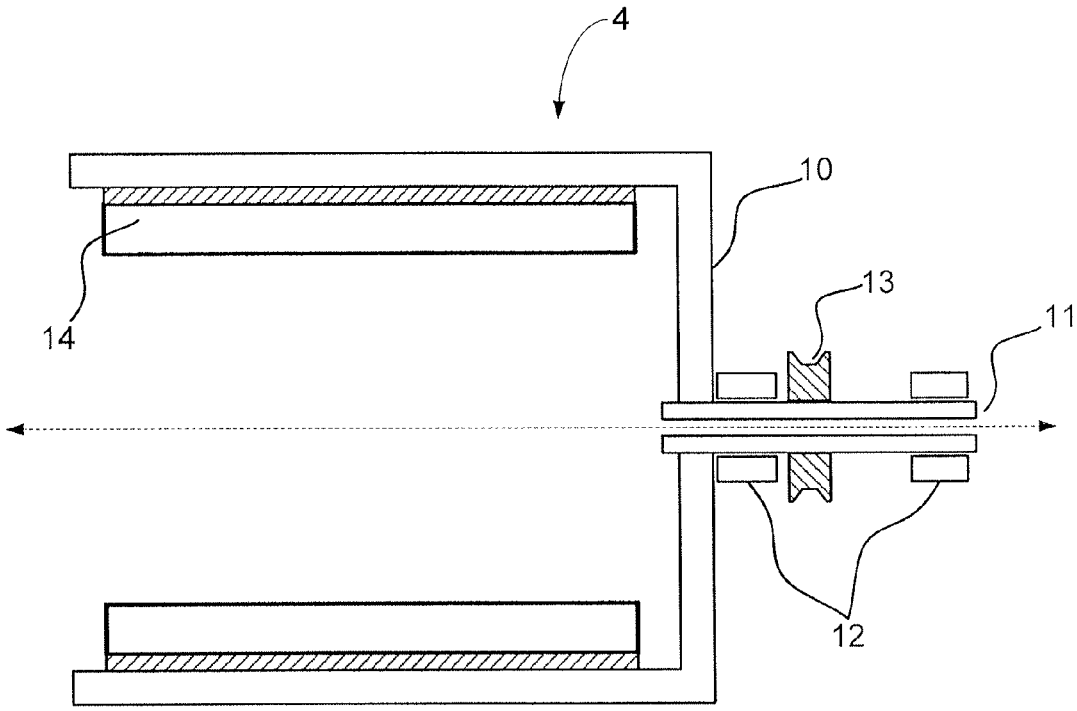
FIG. 2 is a cross-sectional side view of a dryer drum and drive system within which the invention may be implemented.
Figure 9:
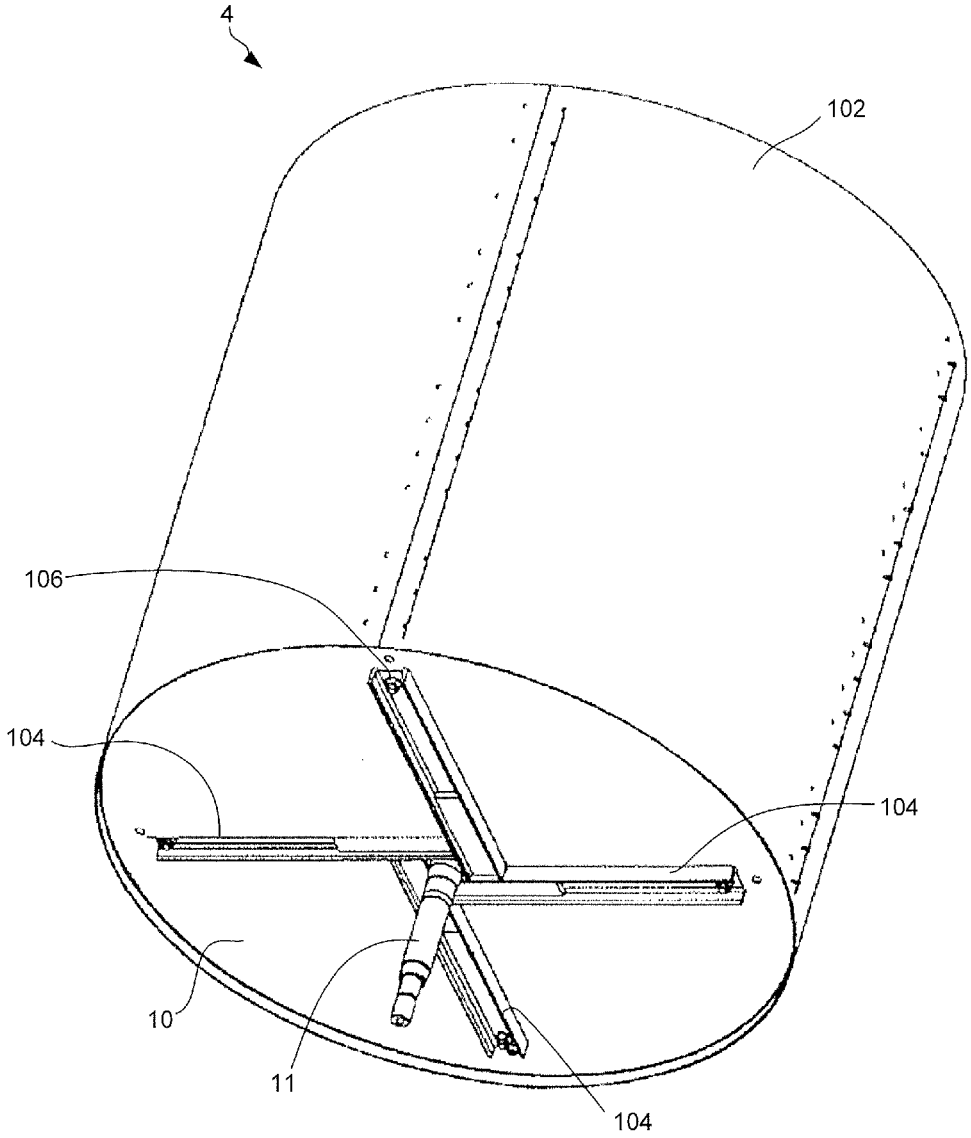
FIG. 9 is a perspective view of a drum or tumbler in accordance with embodiments of the present invention.

The tumbler or drum 4, which is shown in greater detail in FIG. 2, has a rear end wall 10 with a rearwardly-extending shaft 11 supported by bearings 12 within the cabinet 2. The shaft 11 carries a drive pulley 13 coupled to a drive motor of the dryer. The tumbler 4 has a plurality of longitudinally-extending generally V-shaped ribs or baffles 14 projecting radially inwardly from the cylindrical wall of the tumbler 4 for engaging and moving items during drying. The tumbler 4 may have a supporting trunnion to the support shaft 11, as shown in FIG. 9, which illustrates the tumbler 4 from a rear perspective and removed from the laundry dryer 1. In reference to FIG. 9, the tumbler 4 is formed by cylindrical segment panels 102 that are connected to define a hollow cylinder having an end cap at the rear end-wall 10. The trunnion is disposed along the rear end-wall 10 and includes four beams 104 disposed perpendicularly to one another. Each beam 104 is connected to the rear end wall 10 to provide structural rigidity thereto and to help support the weight of laundry disposed in the tumbler 4 during use. Further, in the illustrated embodiment, each beam 104 has a generally U-shaped cross section that defines a channel 106 along the longitudinal centerline of each beam 104. In the illustration of FIG. 2, conventional dryer components such as a heat source, a blower and a motor are not shown because their operation is believed to be well known and not required for understanding of the present invention. In the illustrated embodiment, an operator actuatable control panel 6 is mounted in a front panel of the cabinet 2 and is coupled to a controller 15 (FIG. 1) located within the cabinet 2 behind the control panel 6.

The controller 15 is a combination of hardware, such as a processor and associated circuitry, and software, i.e., computer-readable instructions stored on a non-transitory computer-readable medium, whereby the processor is able to access the stored instructions and operate in the instructed fashion to monitor and control the operation of the of the laundry dryer 1. Thus, the controller-implemented steps described herein are executed in this way, i.e., by the processor in accordance with computer-readable instructions. The body of instructions includes instructions for accepting data from outside sources such as the control panel 6, the drum 4 and baffles 14, and other components and systems as will be discussed in detail hereinafter.

Figure 3:
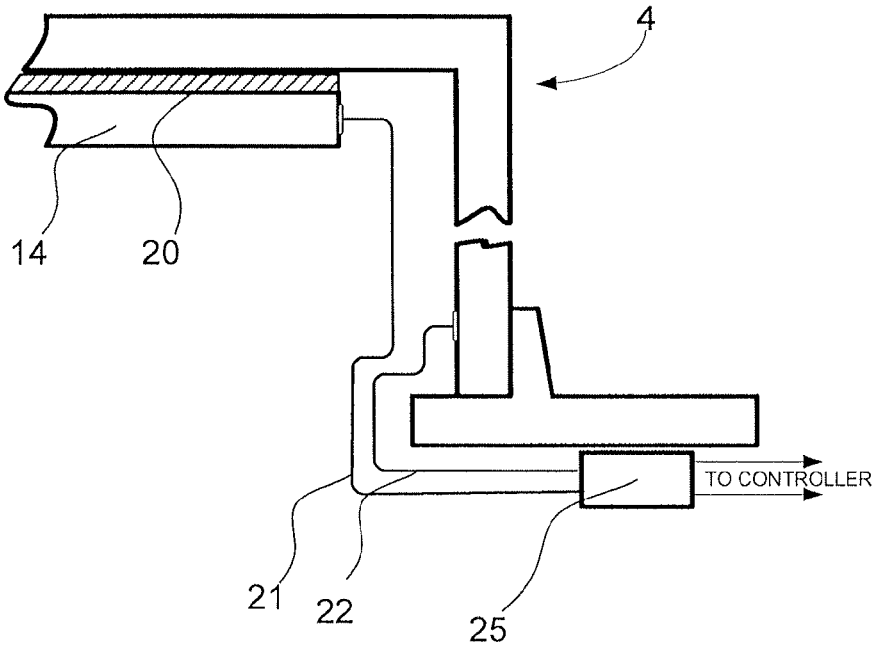
FIG. 3 is a partial cross-sectional side view of a dryer drum having moisture detection features in accordance with embodiments of the present invention.

In accordance with the invention, a moisture sensing control function is provided for enabling the determination of the actual or measured moisture content of laundered items during operation of the dryer. In particular, as shown in the embodiment of FIG. 3, one or more of the baffles 14 are insulated from the tumbler 4 by an insulating layer 20. The baffles 14 and the tumbler 4 are constructed of an electrically conductive material, e.g., steel or aluminum, but in their static state no conduction occurs between them due to the insulating layer 20.

Figure 10:
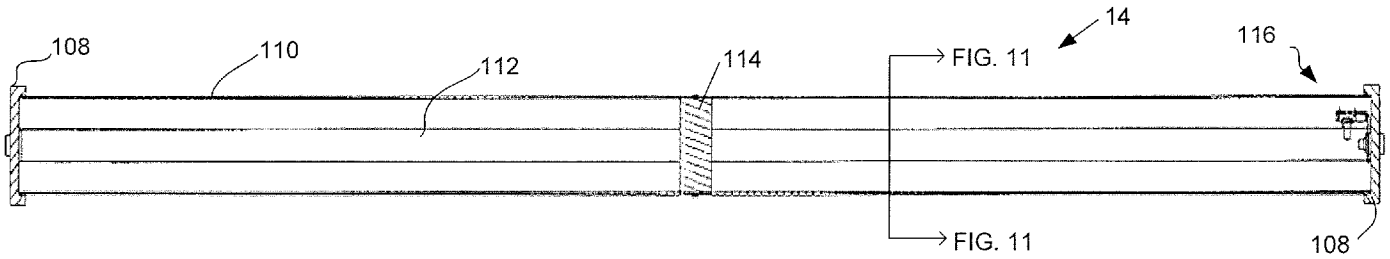
FIGS. 10 and 11 are cross sections of a baffle in accordance with embodiments of the invention.
Figure 12:
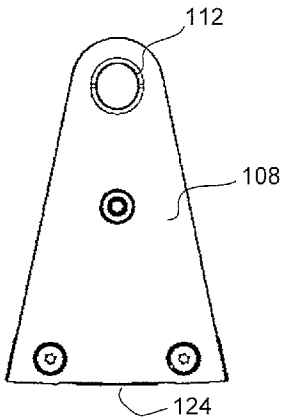
FIG. 12 is a perspective front view of an end-cap for a baffle in accordance with embodiments of the invention.
Figure 11:
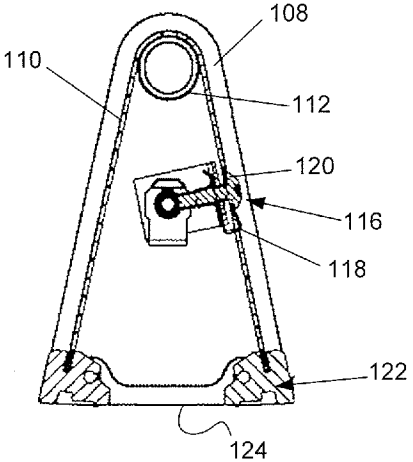

Two cross sections of one embodiment for a baffle 14 are shown in FIGS. 10 and 11. The cross section in FIG. 10 is taken along a longitudinal direction and the cross section of FIG. 11 is taken in a transverse direction. A perspective view of a baffle end-cap 108 is shown in FIG. 12. In reference to these figures, each baffle 14 includes two end-caps 108 disposed on either end of an elongate, generally V-shaped fin 110. The fin 110 may be made of an electrically conductive material such as steel, and the end-caps may be made of an electrically insulating material such as ceramic or plastic. A strengthening bar 112 extends along a longitudinal axis of the baffle 14. As shown, a spacer 114 is disposed at about the longitudinal midsection of the baffle 14 to provide support to the fin 110. The fin 110 may be made of a sheet metal section that has been bent into the desired shape, and includes an electrical connection 116, which in the illustrated embodiment includes a clip 118 having a screw 120 configured to secure an electrical lead onto the fin 110 of the baffle 14. Electrical insulation between the fin 110 and the tumbler 4 is provided by an air gap 122 defined between the fin 110 and an attachment surface 124 of the end-caps 108 to an inner peripheral surface of the tumbler 4.

In reference to FIG. 3, the system for moisture detection includes a conductive lead 21 connected to each baffle 14 as well as a conductive lead 22 electrically connected to the drum 4. In the embodiment shown in FIG. 11, the lead 22 would be connected to the electrical connection 116. Each of these leads 21, 22 will rotate when the drum 4 rotates during operation, and in the preferred embodiment a commutator or rotary coupling 25 is used, a specific slip ring embodiment of which is discussed later herein. In an alternative embodiment of the invention, a simple plate and brush arrangement such as in a typical commutator may be used.

Thus, in whatever fashion is appropriate in a given installation, the signals from leads 21, 22 are brought out of the rotating drum 4 on leads 23, 24 respectively and fed to controller 15. In this way, the controller 15 is able to observe and analyze the conductivity between the baffles 14 and the drum 4, which results when an electrical current passes between the baffle, drum and launderable items present in the drum.

In their static state, there will be no conductivity between these components. However, during operation, when wet items are in the dryer 1 being dried, these items will periodically contact the baffle 14 and the drum 4 at the same time or in a combination so as to provide a conductive path between the baffles 14 and the drum 4, and the sensed conductivity will thus change. Moreover, as the items continue to dry and their moisture content decreases, the degree of conductivity observed will also decrease. In this way, the controller may obtain moisture signals indicative of the degree of moisture content in the items being dried at any interval in time during the drying cycle. In one embodiment, these moisture signals are in the form of a voltage taken at leads of a voltage divider having a variable resistance path that includes the baffle, drum and launderable items, as described in further detail below relative to FIG. 13.

Although the dryer 1, via the controller 15 and associated data feeds is thus able to produce an indication of the moisture content in the items being dried, the question remains of how a relatively inexperienced user might employ that information to reach a desired dryness if the user is not sufficiently familiar with the touch-feel of various moisture content percentages. In other words, it is desired that the system is configured to provide an absolute determination of moisture content in the laundered items. To allow the user to set the dryer 1 to produce items having a desired moisture content therefore, the controller is configured to allow the user to set the cycle so as to correlate a certain touch feel having the desired characteristics with a specific moisture percentage and corresponding drying program. In this way, the user can repeatedly dry items to the desired moisture content without a prior knowledge regarding the various numerical measures of moisture content. Alternatively or additionally, the controller is configured to automatically stop a drying cycle, without direct intervention by the user, when a predetermined moisture content has been reached.

Figure 4:
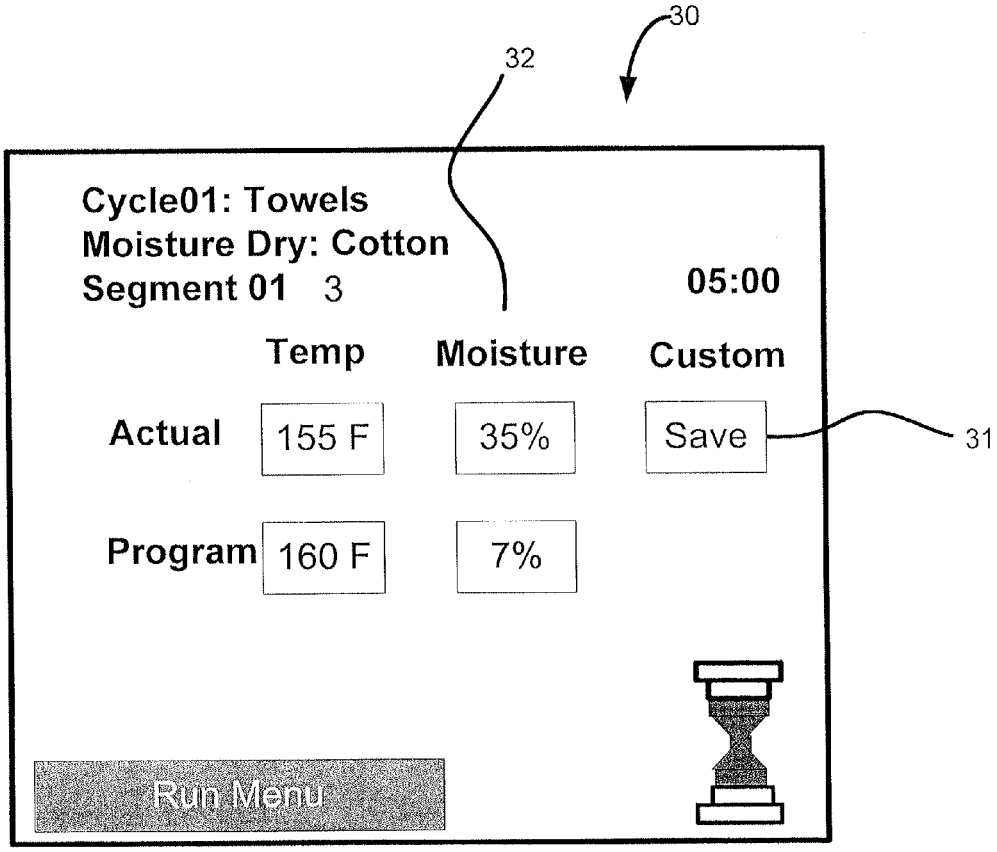
FIG. 4 is a schematic view of a user interface panel in accordance with embodiments of the present invention.

To this end, the control panel 6 provides a user interface 30 as shown in FIG. 4, usable by the operator to set a setpoint dryness. The user interface 30 includes a setpoint element 31 for setting a dryness or wetness setpoint. The setpoint element 31 may be a touch screen menu item as shown, or a button, switch, etc. Whatever the physical implementation of the setpoint element 31, its actuation serves to set a setpoint moisture level to which the dryer will dry items when drying in the current mode.

Thus, for example, in one embodiment, if the dryer is being used to dry linens on a "hot" setting (or has a "linen" or "cotton" setting that is being used), the user may actuate the setpoint element 31 when the operator detects by touch that the items have reached the proper level of dryness. In this operation, the user need not know or care what the exact moisture content of the items is at that time.

In response to the user selection of the setpoint element 31, the controller 15 sets an association in memory between that mode (or a sub-mode such as "cotton-1") and a specific moisture content, i.e., the moisture content exhibited at the time that the setpoint element 31 was selected. The user may or may not be apprised of what that content is. In the illustrated embodiment, the moisture content is displayed to the user via a moisture content display item 32.

In this way, when the dryer 1 is subsequently used for a similar load of items, the operator can simply select the mode or sub-mode associated with the previously set setpoint and the dryer 1 will dry the contents to the same percentage of moisture previously approved by the operator. Once the setpoint is set in an initial load, there is no need for the operator to periodically check the feel of the items during subsequent loads.

Figure 5:
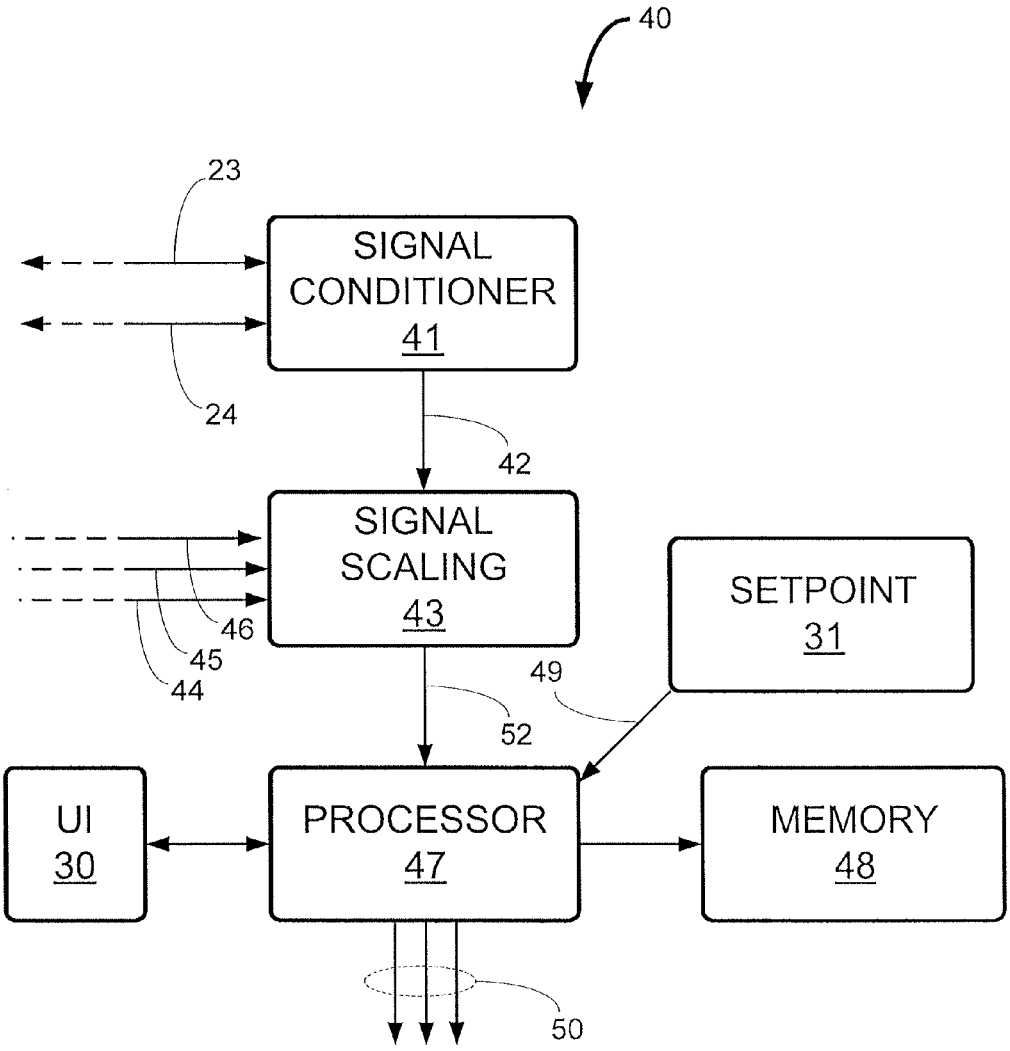
FIG. 5 is a circuit and control schematic diagram in accordance with embodiments of the present invention.

In carrying out the present embodiment, for providing moisture sensing input signals to the control, a sensing logic circuit 40 is provided, such as depicted in FIG. 5. To this end, the circuit 40 includes a signal conditioner module 41, which provides a voltage to the baffle 14 and drum 4 via the leads 21-24 and detects the current flowing in that circuit. The current is smoothed over numerous sampling cycles to produce a current or voltage output signal 42 indicative of the sensed conductivity. Thus, within a range of output voltages of 0.0 V (a conductivity of 0% being indicative of an open circuit condition) to 5.0V (a conductivity of 100% being indicative of a short circuit condition), a middle value, e.g., 2.3V, provides a measure of the extent to which conductivity exists between the baffle 14 and the drum 4.

However, the conductivity of various materials used to make launderable items at the same level of moisture content may vary. Thus, for example, a load of towels at a moisture content of 15% may exhibit the same conductivity as a load of linens with a moisture content of 10%. Thus, the output signal 42 is provided to a scaling module 43 for application of a multifactor analysis to arrive at an appropriate moisture content for the machine, load size, load composition, etc. These additional factors may be input at input at inputs 44, 45, 46 via automatic detection or use input.

The scaling module 43 outputs a percentage moisture value 52, which is fed to the controller processor 47 and from there to memory 48 and the user interface 30. An input 49 from the setpoint element 31 is also received by the processor 47. The processor 47 also has various control outputs 50 to control the operation of the dryer 1.

Figure 13:
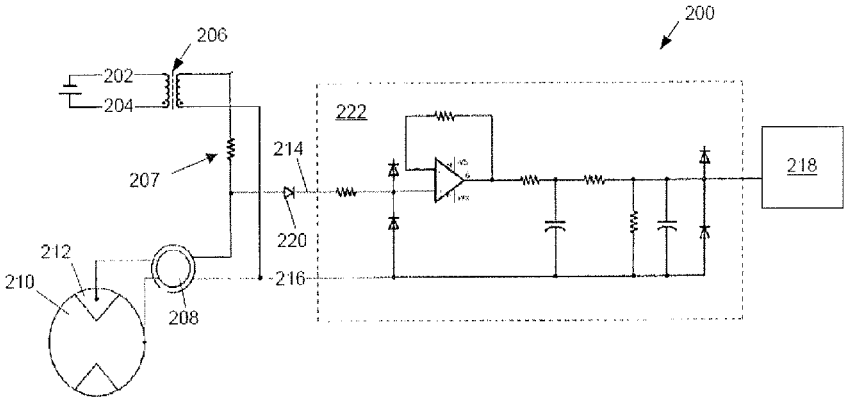
FIG. 13 is an electrical circuit schematic for a moisture detection system in accordance with embodiments of the invention.

A circuit diagram for one embodiment of a moisture sensing system 200 that interfaces with the logic circuit 40 (FIG. 5) is shown in FIG. 13. The system 200 includes first and second leads 202 and 204 that are connected, respectively, to positive and negative terminals of a direct current (DC) voltage source, V. The voltage V passes through a step-down transformer 206 before being placed in series electrical connection between the tumbler 210 and baffles 212 through a slip ring arrangement 208, as previously described. An electrical voltage divider circuit is formed between the leads 202 and 204 as current passes from the tumbler 210 to the baffles 212 by way of electrical current or leakage that is transmitted at a varying degree through the humidity present in a load of laundry. In this way, a voltage that exists between sensor leads 214 and 216 will be indicative of the dampness of a load of laundry within the tumbler 210 in that a higher voltage that is present is indicative of a higher rate of current. The sensor leads 214 and 216 provide a moisture signal indicative of the moisture present in the load of laundry to an electronic controller or microcontroller 218. The moisture signal in the illustrated embodiment is rectified through a diode 220 and conditioned through a high-impedance step-down circuit 222.

During operation, a voltage provided from the voltage divider arrangement that includes an electrical path through the laundry load and a reference resistor 207, as described relative to FIG. 13, yields a direct current (DC) voltage across the sensor leads 214 and 216 that is rectified and signal-conditioned so that the microcontroller 218 can monitor an analog DC voltage that is proportional to the moisture content in the laundry load.

The microcontroller 218 can be configured in this way to monitor and control the operation of the dryer 1 such that the dryer can shut down and/or enter into a cool-down operating mode when a predetermined moisture setpoint of the laundry load, as indicated by the moisture signal being substantially at or above a predetermined threshold value, has been reached. The moisture signal thus provided may contain high frequency noise caused by various factors, such as the tumbling action of the articles in the laundry load, electrical interference in the dryer 1, ambient electrical interference, static electricity generated in the tumbler and other factors. For this reason, the microcontroller 218 may include signal conditioning circuits and/or algorithms that operate as low-pass filters. The parameters of such low pass filters, however, may change depending on the size and composition of a particular load, as well as the particular type of machine. For example, a cotton material type on a particular machine type may involve a different low-pass filter cutoff frequency than the same type of load on a different type of machine or a different type of load, for example, bedding, wool, cotton blend, synthetic or delicate fabrics, on the same machine type.

The various low-pass filter cutoff frequencies for various machine and load types can be determined experimentally. Additionally, transfer functions correlating load moisture content with sensor voltage can also be determined experimentally for various machine and load types. The low-pass filter cutoff frequency and transfer function corresponding to a user-selectable load type for each machine can thus be determined and stored within the microcontroller for a particular machine type. In one embodiment, the cutoff frequency and/or transfer function can be integrated into a model-based algorithm. In the illustrated embodiments, transfer functions in the form of a fourth-order polynomial, which have been determined to have sufficient resolution for monitoring the moisture content of a load of laundry, are shown and discussed, but other types of functions including model-based and fuzzy-logic functions and transforms may be used. Two representative transfer functions, each corresponding to a particular type of laundry load composition, are shown plotted in a single graph in FIG. 14.

Figure 14:
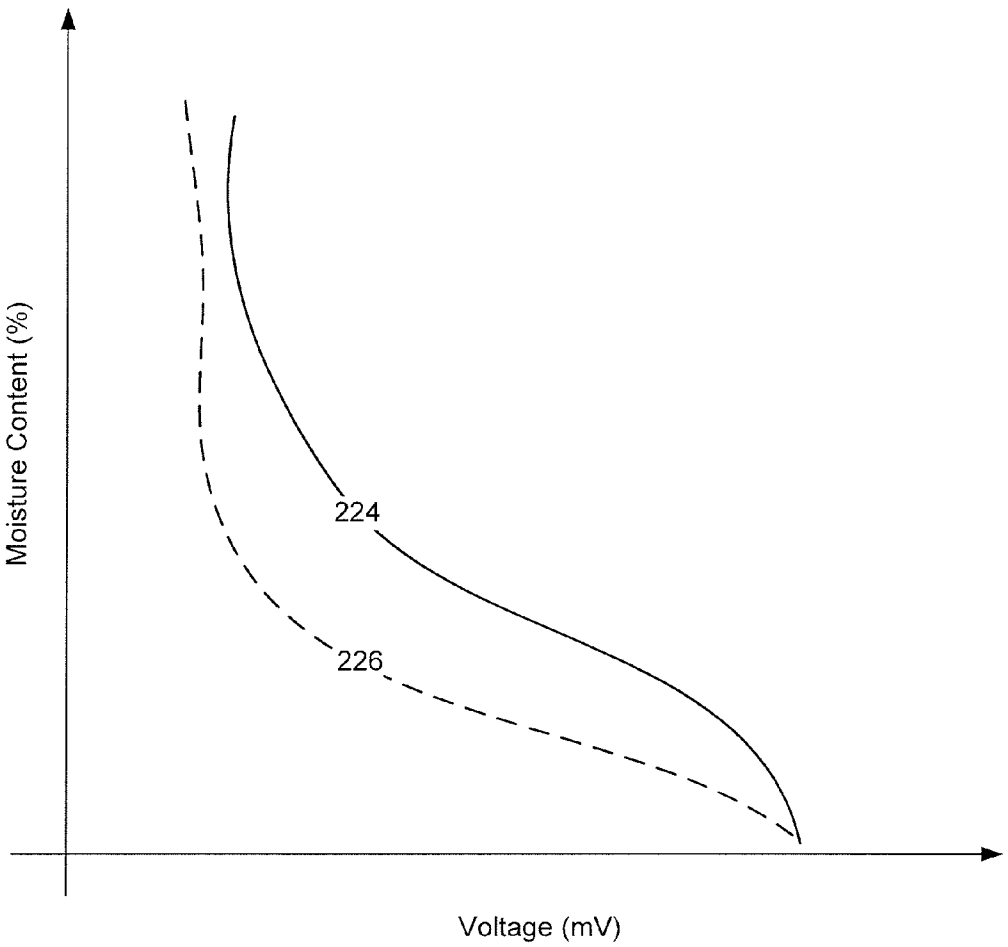
FIG. 14 is a graph depicting two transfer functions for use with a moisture sensing system in accordance with embodiments of the present invention.

In reference to FIG. 14, the illustrated qualitative graph plots the voltage value of a moisture signal as described relative to FIG. 13 on the horizontal axis against a percent (%) relative moisture content of the corresponding load of laundry on the vertical axis. A first curve 224, which is shown in solid line, is a fourth-degree polynomial and represents the transfer function that was experimentally determined for a 35-lb. (15.9 kg.) load of cotton terry cloth towels. A second curve 226, which is shown in dashed line, is also a fourth-degree polynomial that represents the transfer function for a 35-lb. load containing 50% cotton/50% polyester blend towels. Both polynomials for the first and second curves 224 and 226 are of the form:

$$Y=Ax^4+Bx^3+Cx^2+Dx+E$$

where the coefficients A, B, C, D and E for the cotton load (first curve 224) and for the mixed load (second curve 226) were experimentally determined and are shown in Table 1 below:

TABLE 1

| | A | B | C | D | E |
|---|---|---|---|---|---|
| 100% Cotton | −3.02E−8 | 1.23E−5 | −9.99E−4 | 2.03E−1 | 4.03E+1 |
| 50% Cotton/ 50% Polyester Blend | 3.95E−8 | −2.97E−5 | 7.93E−3 | −9.34E−1 | 4.92E+1 |

As can be seen from the graph, although the two curves 224 and 226 have different characteristics, the coefficients shown in Table 1 that are experimentally determined have been found to be consistent and correct for the particular parameters used to determine them. In other words, an initial calibration through experimentation may be made, and tables containing appropriate coefficients for varying operating parameters of a machine may be created and stored in the controller at the manufacturer for later use during service. In this way, parameters about a particular load that are input by a user or are otherwise determined by the machine, such as type of launderable item, weight of load etc. can be input to the controller. The controller may then look up the appropriate coefficients corresponding to the parameters provided and use then during the drying cycle to more accurately determine the proper transfer function and cutoff frequency that will be used.

In further carrying out the present embodiment, as noted above, a rotary coupling 60 is provided for electrically coupling the rotary drum 4 and baffles 14 to the controller 15. Although a standard commutator may be used, the size and wear characteristics of such a system are not ideal. Thus, in an embodiment of the invention, a slip ring is configured and applied to allow the signals from the drum 4 and the baffle 14 to be extracted from the rotating drum 4 to the non-rotating components of the dryer.

Figure 6:
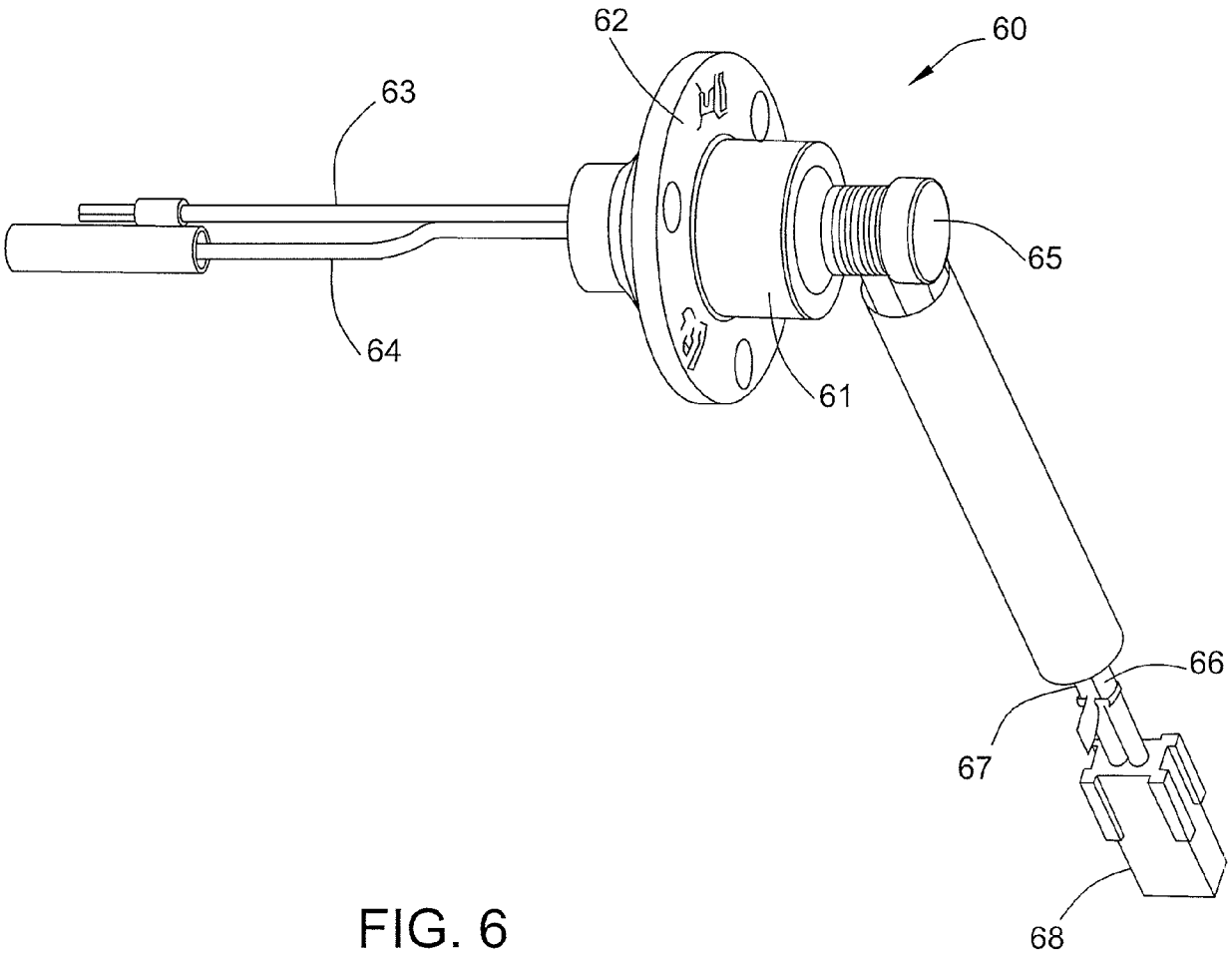
FIG. 6 is a perspective side view of a slip joint housing and connections usable in accordance with embodiments of the present invention.

An exemplary slip ring assembly 60 is shown in FIG. 6. The assembly 60 includes a main body or housing having a mounting flange 62 for attachment to the dryer 1 or dryer drum 4. Rotatable input connections 63 and 64 are provided to receive signals on leads 21 and 22 (from the baffles 14 and drum 4). These rotatable connections 63, 64 are rotatably linked via a slip ring within housing 61 to a fixed output point 65, which provides matching output connections 66,67. As in the illustrated embodiment, a connector plug 68 may be provided to mate the output connections 66,67 to a mating plug to provide the signals to leads of the controller 15.

The slip ring assembly is not electrically reactive, i.e., not inductive or capacitive, and as such may pass both DC and AC signals. In an embodiment of the invention, the controller 15 uses AC signals to probe the conductivity between the baffles 14 and drum 4. In this embodiment, the AC signal aids in the prevention of plating that may otherwise occur with long term use of DC signals. Such plating could interfere with accurate current and/or voltage measurements.

Figure 7:
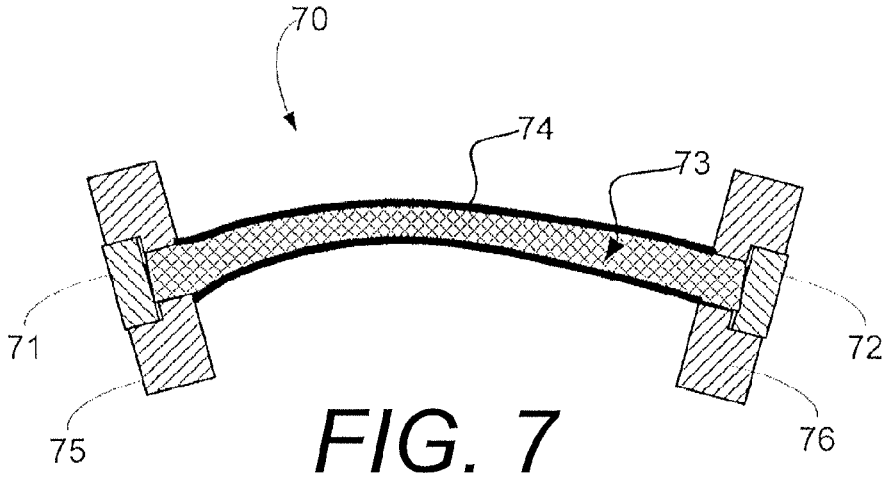
FIGS. 7 and 8 are cross-sectional side views of a pair of diagnostic jumpers usable to detect a short or open circuit in moisture detection connections in accordance with embodiments of the present invention.
Figure 8:
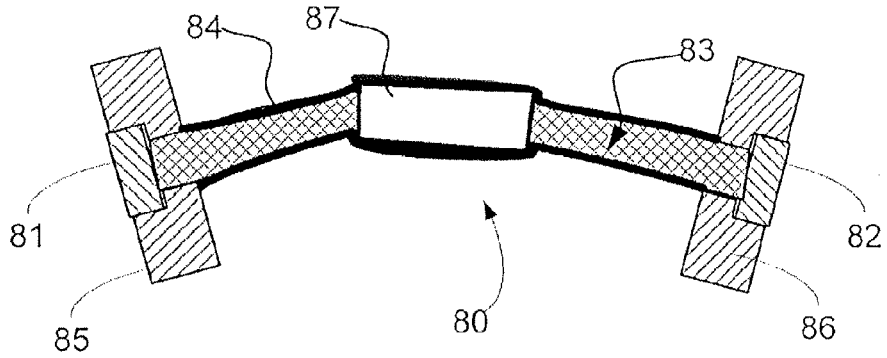

As a further feature of the moisture sensing control system and circuitry illustrated, its operative status may be easily monitored without disassembly of the dryer. To this end a pair of magnetic jumpers are provided with each jumper serving a specific diagnostic purpose and being installable within the dryer drum 4 for diagnostic purposes and without requiring disassembly of the dryer for internal access to various components. A pair of jumpers is shown in FIGS. 7 and 8.

In particular, in carrying out an analysis of the machine condition, a first diagnostic jumper 70 is provided having a first terminus 71 and a second terminus 72, and further having a flexible linkage 73 tying the first terminus 71 and second terminus 72 together. The linkage 73 of the first diagnostic jumper 70 is a highly conductive material such as steel or copper braid. The linkage 73 may be insulated by flexible insulator 74, e.g., made of rubber or plastic material, in order to prevent inadvertent electrical contact of the linkage 73 to any item or surface while in use.

Each terminus 71, 72 has affixed thereto a respective magnetic body 75, 76 in order to allow it to be fixably applied to a surface of the drum 4 or baffle 14. Due to the magnetic manner of attachment, this embodiment is adapted for use with steel or otherwise ferrous components. In the case of non-ferrous components, other means of attachment, e.g., clips, screws, etc., would be used instead.

A second diagnostic jumper 80 is provided having many of the same elements as the first, including a first terminus 81, second terminus 82, flexible linkage 83, flexible insulator 74, and respective magnetic bodies 85, 86. However, the linkage 83 of the first diagnostic jumper 70, while it may comprise a highly conductive material such as steel or copper braid, also contains a resistor 87.

In this way, the first diagnostic jumper 70 presents a short circuit path when connected between two conductive surfaces, while the second diagnostic jumper 80 presents a resistive path when connected between two conductive surfaces.

As such, the first diagnostic jumper 70, when placed between a baffle 14 and the drum 4 will mimic a high moisture content load, where the second diagnostic jumper 80 will mimic a less conductive, and therefore less wet load.

By using these jumpers, the operator can confirm that the condition of the machine has not drifted, via a short, breakage, or accumulation of material, to create a defect that is itself mimicking a wet or dry load and preventing accurate moisture analysis. Alternatively, the jumpers can be used to calibrate low and high voltage readings in the microcontroller such that any drift can be compensated for. In either case, the user first places the first diagnostic jumper 70 by affixing one end to a baffle 14 and the other end to the drum 4, creating a short between the two.

By now running the machine empty but for the jumper, the operator should observe a moisture indicator showing the highest level of moisture. If the aforementioned diagnostic check does not yield a high moisture reading, this is indicative of an error in the machine, potentially in the form of an open circuit along the path of the moisture sensing leads up to the controller 15.

Assuming success of the first diagnostic check, the user then removes the first diagnostic jumper 70 and installs the second diagnostic jumper 80 by affixing one end to a baffle 14 and the other end to the drum 4, creating a resistive path between the two. By now running the machine empty but for the second jumper, the operator should now observe a moisture indicator showing a moderate level of moisture (depending on the level of resistance used). If this diagnostic check yields a high moisture reading, this is indicative of an error in the machine, potentially in the form of a short circuit along the path of the moisture sensing leads up to the controller 15. Once the user has determined that there is no error, the machine may again be used with confidence.

It will be appreciated that a new and useful system and technique for moisture sensing and for dryer control based on a determination of the moisture of the load of laundry have been described. However, these preferred embodiments described herein are not meant to be limiting. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

LIST OF ELEMENTS

| No. | Description |
|---|---|
| 1 | dryer |
| 2 | cabinet |
| 3 | door |
| 4 | drum |
| 5 | glass pane |
| 6 | control panel |
| 10 | rear end wall |
| 11 | rearwardly-extending shaft |
| 12 | bearings |
| 13 | drive pulley |
| 14 | baffle |
| 15 | controller |
| 20 | insulating layer |
| 21 | conductive lead |
| 22 | conductive lead |
| 23 | lead |
| 24 | lead |
| 30 | user interface |
| 31 | setpoint element |
| 40 | circuit |
| 41 | signal conditioner module |
| 42 | output signal |
| 43 | scaling module |
| 44 | inputs |
| 45 | inputs |
| 46 | inputs |
| 47 | controller processor |
| 48 | memory |
| 50 | various control outputs |
| 52 | moisture value |
| 60 | slip ring assembly |
| 61 | housing |
| 62 | mounting flange |
| 63 | rotatable connections |
| 64 | rotatable connections |
| 65 | fixed output point |
| 66 | matching output connection |
| 67 | matching output connection |
| 68 | connector plug |
| 70 | first diagnostic jumper |
| 71 | first terminus |
| 72 | second terminus |
| 73 | flexible linkage |
| 74 | flexible insulator |
| 75 | magnetic body |
| 76 | magnetic body |
| 80 | second diagnostic jumper |
| 81 | first terminus |
| 82 | second terminus |
| 83 | flexible linkage |
| 85 | magnetic bodies |
| 86 | magnetic bodies |
| 87 | resistor |
| 102 | cylindrical segment panels |
| 104 | beams |
| 106 | channel |
| 108 | baffle end-cap |
| 110 | fin |
| 112 | strengthening bar |
| 114 | spacer |
| 116 | electrical connection |
| 118 | clip |
| 120 | screw |
| 122 | air gap |
| 124 | attachment surface |
| 200 | moisture sensing system |

-continued

| No. | Description |
|---|---|
| 202 | first lead |
| 204 | second lead |
| 206 | step-down transformer |
| 208 | slip ring arrangement |
| 210 | tumbler |
| 212 | baffles |
| 214 | sensor leads |
| 216 | sensor leads |
| 218 | microcontroller |
| 220 | diode |
| 222 | high-impedance step-down circuit |
| 224 | first curve |
| 226 | second curve |

The invention claimed is:

1. A laundry dryer machine having an improved moisture detection capability comprising:

a dryer drum adapted such that moisture-containing launderable items may be placed inside the drum to be dried by applied heat and rotary motion of the dryer drum;

a moisture sensing system configured to detect an average moisture content of the moisture-containing launderable items as they are dried within the drum and provide a moisture signal to an electronic controller, the moisture signal being representative of a parameter related to a moisture content of the launderable items; and a user interface presenting a setpoint selection element such that when a moisture setpoint is selected by a machine operator during a drying cycle, an operational state of the dryer machine is controlled by the electronic controller based on the moisture setpoint and the moisture signal;

wherein the electronic controller is configured to apply an appropriate transfer function to the moisture signal when determining the average moisture content, the appropriate transfer function being predetermined based on an earlier operation cycle of the laundry machine.

2. The laundry dryer machine of claim 1, further comprising:

at least one baffle disposed in electrically isolated relation on an internal cylindrical surface within the dryer drum, the at least one baffle configured to agitate the launderable items when the dryer drum is rotating;

wherein the moisture signal is related to an electrical current that passes between the at least one baffle, the launderable items and the dryer drum when the dryer drum is rotating.

3. The laundry dryer machine of claim 2, wherein the moisture sensing system comprises a first electrical lead connected to the dryer drum, a second electrical lead connected to the at least one baffle, and first and second sensor leads connected to the electronic controller, wherein an electrical commutator electrically connects the first lead with the first sensor lead and the second lead with the second sensor lead.

4. The laundry machine of claim 3, wherein the commutator is a slip-ring arrangement.

5. The laundry machine of claim 3, wherein a reference resistor is electrically placed in-line with one of the first and second leads such that a voltage divider arrangement is electrically constructed across the first and second leads, the first and second sensor leads, and the dryer drum and at least one baffle.

6. The laundry machine of claim 1, further including a low-pass filter applied to the moisture signal, the low-pass filter having a selectable cutoff frequency that depends, at least in part, on a type of the launderable items.

7. The laundry machine of claim 1, wherein the appropriate transfer function is predetermined based on at least one of a type of material used to make the launderable items, a weight of a laundry load that contains the launderable items, and a machine type of the laundry machine.

8. A moisture detection system and control for a laundry machine, the moisture detection system and control adapted for detecting moisture in a load of laundry disposed within a tumbler of a laundry machine, comprising:

at least one baffle disposed in electrically isolated relation on an internal cylindrical surface of the tumbler, the at least one baffle configured to agitate the load of laundry when the tumbler is rotating;

a moisture sensing system configured to detect an average moisture content of load of laundry and provide a moisture signal indicative of the average moisture content to an electronic controller;

a user interface associated with the electronic controller, the user interface configured to provide a target moisture setpoint for the load of laundry;

wherein the electronic controller is configured to compare the moisture signal with the target moisture setpoint and discontinue a drying operation of the tumbler when the moisture signal is indicative of an average moisture content that is at or below the target moisture setpoint;

wherein the electronic controller is configured to apply an appropriate transfer function to the moisture signal when determining the average moisture content, the appropriate transfer function being predetermined based on an earlier operation cycle of the laundry machine.

9. The moisture detection system and control of claim 8, wherein the moisture sensing system comprises a first electrical lead connected to a housing of the tumbler, a second electrical lead connected to the at least one baffle, and first and second sensor leads connected to the electronic controller, wherein an electrical commutator electrically connects the first lead with the first sensor lead and the second lead with the second sensor lead.

10. The moisture detection system and control of claim 9, wherein the commutator is a slip-ring arrangement.

11. The moisture detection system and control of claim 9, wherein a reference resistor is electrically placed in-line with one of the first and second leads such that a voltage divider arrangement is electrically constructed across the first and second leads, the first and second sensor leads, and the dryer drum and at least one baffle.

12. The moisture detection system and control of claim 8, further including a low-pass filter applied to the moisture signal, the low-pass filter having a selectable cutoff frequency that depends, at least in part, on a type of material of items that make up the load of laundry.

13. The moisture detection system and control of claim 8, wherein the appropriate transfer function is predetermined based on at least one of a type of material used to make launderable items in the load of laundry, a weight of a load of laundry, and a machine type of the laundry machine.

* * * * *